US005283618A

United States Patent [19]

Hosoya et al.

[11] Patent Number: 5,283,618

[45] Date of Patent: Feb. 1, 1994

[54] CLEANERLESS DEVELOPING METHOD USING MONO-COMPONENT TONER

[75] Inventors: Masahiro Hosoya, Okegawa; Mitsunaga Saito, Ichikawa; Isutomu Uehara, Yokosuka; Yukihiro Osugi, Tagata, all of Japan

[73] Assignee: Kabushiki Kaisha Toshiba, Kanagawa, Japan

[21] Appl. No.: 902,748

[22] Filed: Jun. 23, 1992

[30] Foreign Application Priority Data

Jun. 25, 1991 [JP] Japan ..... 3-153197

[51] Int. Cl.[5] ..... G03G 15/06; G03G 21/00

[52] U.S. Cl. ..... 355/269; 118/652; 355/215; 355/245; 355/270; 355/296; 430/125

[58] Field of Search ..... 355/269, 270, 296, 297, 355/299, 301, 303, 219, 215, 245; 118/652; 430/125; 361/225, 221

[56] References Cited

U.S. PATENT DOCUMENTS 4,623,604 11/1986 Takagiwa et al. ..... 430/109

FOREIGN PATENT DOCUMENTS 59-133573 7/1984 Japan .
59-157661 9/1984 Japan .
62-203183 9/1987 Japan .

*Primary Examiner*—A. T. Grimley
*Assistant Examiner*—Mathew S. Smith
*Attorney, Agent, or Firm*—Finnegan, Henderson, Farabow, Garrett & Dunner

[57] ABSTRACT

This invention relates to a cleanerless developing method using a mono-component toner, which method effects simultaneous developing and cleaning operations in the step of development. It more particularly relates to a method which is capable of forming images of outstanding quality without entailing generation of positive memory or negative memory. In the cleanerless developing method using a mono-component toner, the absolute value of the magnitude, $|q_t|$, of charging the developing toner to be used is selected to fall in the range between 0.5 [mC/kg] and 40 [mC/kg], the absolute value of the magnitude, $|q_r|$, of charging the residual toner to be introduced into the step for simultaneous developing and cleaning as deposited on the surface of the latent image retaining member is set to fall in the range between 0.5 [mC/kg] and 60 [mC/kg], or the absolute value of the magnitude, $|q_z|$, of charging the residual toner during the step for uniformizing the residual toner is selected to fall below the upper limit of 40 [mC/kg]. By selecting the magnitude of charging the toner within at least one of the ranges mentioned above, the cleanerless developing method using a mono-component toner is always and easily enabled to produce images of high quality without entailing the generation of positive memory or negative memory.

24 Claims, 12 Drawing Sheets

(a) $q_r = -24$ (mC/kg)

(b) $q_r = -34$ (mC/kg)

CLEANERLESS DEVELOPING METHOD USING MONO-COMPONENT TONER

BACKGROUND OF THE INVENTION

This invention relates to a method for the development of an image based on the principle of electrophotography, and more particularly to a cleanerless developing method by the use of a mono-component toner.

The cleanerless developing method is a method for effecting the development and the recovery into a developing device of the toner remaining after an image transfer step without requiring the use of a cleaning device. The idea underlying this cleanerless developing method is disclosed in Japanese Unexamined Patent Publications No. 133,573/1984, No. 157,661/1984, etc. The essence of the cleanerless developing method disclosed in these publications will be described below as applied to the electrophotographic printer represented by the laser printer which more often than not utilizes the universally known process of reversal development. The construction of the essential part of the electrophotographic printer is illustrated in cross section in FIG. 12.

In the process of reversal development, the particles of toner 2 are first charged to the same polarity as a latent image retaining member 1. Then, the toner 2 particles are allowed to attach to the part destitute (or scanty) of electric charge on the surface of the latent image retaining member 1 which has undergone the step for formation of the latent image and prevented from adhering to the part laden with electric charge.

For the selective adhesion of the toner 2, an intermediate potential $V_b$ between a potential $V_o$ of the charged part and a potential $V_l$ of the non-charged part of the surface of the latent image retaining member 1 ($|V_l| < |V_b| < |V_O|$) is supplied to a toner carrying member 4 inside a developing device 3. As a result, the toner 2 is prevented by the electric field due to the potential difference between $V_0$ and $V_b$ from adhering to the surface of the latent image retaining member 1 and allowed by the electric field due to the potential difference between $V_b$ and $V_l$ to attach to the surface of the latent image retaining member 1. The toner which has adhered to the surface of the latent image retaining member 1 is transferred by a well-known transfer charging device 5 onto the surface of an image supporting member 6. Generally during this step for image transfer, all the toner 2 particles are not transferred and residual toner 2' is left distributed in the pattern of the image on the surface of the latent image retaining member 1 even after the transfer step.

In the ordinary developing method using a cleaner, the residual toner 2' is recovered by a cleaner 7 indicated by a broken line in the diagram. In the cleanerless developing method which has no use for the cleaner 7, the residual toner 2' is recovered by the developing device 3 simultaneously with the operation of development during the step of development.

The recovery of the residual toner 2' during the step of development is carried out as follows. The latent image retaining member 1 carrying the residual toner 2' on the surface thereof is deprived of the electric charge on the surface by a discharging lamp, subjected to uniform charging by the use of a charging device 9, and exposed to a light beam 10 and thereby enabled to form an electrostatic latent image on the surface thereof. The residual toner 2' which persists on the charged part (namely the unexposed or non-image part) in the latent image formed on the surface of the latent image retaining member 1 is substantially charged in the same polarity as the latent image by the charging device 9. The residual toner 2', therefore, is transferred onto the toner carrying member 4 side by the electric field due to the aforementioned potential difference between $V_o$ and $V_b$ during the step of development, leaving the surface of the image retaining member 1 clean behind. At the same time, the residual toner 2' which persists on the non-charged part (namely the exposed or image part) is caused to remain on the surface of the latent image retaining member 1 under the force generated in the direction from the toner carrying member 4 to the latent image retaining member 1 by the electric field due to the potential difference between $V_b$ and $V_l$. A new supply of the toner 2 from the toner carrying member 4 is transferred to the non-charged part and this toner is removed in consequence of the operation of development, leaving the non-charged part clean behind.

The adoption of the cleanerless developing method which has no use for the cleaner 7 or a waste toner box for accommodating the waste toner allows easy construction of a small and simple image forming apparatus. Further, since the residual toner 2' is recovered by the developing device 3 and put to reuse, the cleanerless developing method is economical because waste toner is not produced. The latent image retaining member 1 enjoys a long service life because it is not rubbed away by a cleaning blade.

The cleanerless developing method, however, has the possibility of suffering from the occurrence of ghost images for the following reasons.

Firstly, in a circumstance of high humidity, since the paper as the image supporting member 6 absorbs moisture at a sacrifice of an electrical resistance, the efficiency of transfer is generally degraded to the extent of causing a large amount of the toner to remain on the surface of the latent image retaining member 1. If the amount of the residual toner 2' is unduly large, the developing device 3 is no longer capable of thoroughly cleaning the surface of the latent image retaining member 1 and, as a result, the residual toner 2' remains on the non-image part and give rise to a positive ghost on the white background of the transferred image (hereinafter referred to as "positive ghost" or "positive memory").

Secondly, if the amount of the residual toner 2' is unduly large, since the residual toner 2' during the step of exposure to the light beam 10 intercepts the light beam 10, the surface potential of the latent image retaining member 1 is not amply attenuated but is suffered to settle to the potential state intermediate between $V_o$ and $V_l$ (to be denoted as $V_l'$). Since the site of this description assumes a developing voltage ($V_b - V_l'$) which is smaller in magnitude than the developing voltage ($V_b - V_l$) in the surrounding exposed part, the amount of the toner to be transferred from the toner carrying member 4 to the latent image retaining member 1 in this site is smaller than in the surrounding part. In the image part formed in consequence of the transfer of the toner, therefore, the image of residual toner is manifested as a void image (hereinafter referred to as "negative ghost" or "negative memory"). This phenomenon appears with added conspicuity in a halftone image which is an aggregate of screen image lines and line images.

An effort has been made to elucidate the mechanism which underlies the technique of simultaneous developing and cleaning by studying a model simultaneous developing and cleaning process in the cleanerless developing method described above [Hosoya et al., P 189; '90 Glossary of Japan Hardcopy Reports (1990)]. In this report, the authors particularly discuss the relationship between the amount of the residual toner 2' and the occurrence of memory.

A method for precluding the ghost is disclosed in Japanese Unexamined Patent Publication No. 203,183/1987. This method comprises applying DC voltage of a polarity opposite the polarity of the charged toner to an electroconductive brush kept in gentle contact with the surface of the latent image retaining member 1 thereby inducing tentative attraction of the residual toner to the electroconductive brush by virtue of the Coulomb force. Since the capacity of the electroconductive brush for holding the attracted toner has its limit, the toner which has been attracted by this brush to the saturated level is gradually shed from the brush, deposited on the surface of the latent image retaining member, and forwarded to the step of exposure and the step of development. Since the toner deposited on the surface of the latent image retaining member is uniformly distributed, the interception of light beam during the step of exposure and the defective cleaning of the surface during the step of development are repressed and the otherwise possible occurrence of memory is precluded.

The positive memory and the negative memory occur often even after the aforementioned operation for uniformizing the toner by the electroconductive brush has been performed.

In the development which is performed in accordance with the conventional cleanerless developing method and cleanerless developing apparatus, therefore, it is difficult to accomplish substantially complete prevention of the occurrence of memory. A desire is expressed, therefore, for solving all these problems.

SUMMARY OF THE INVENTION

An object of this invention is to provide a cleanerless developing method using a mono-component toner, which method is capable of substantially precluding the positive memory or negative memory which would otherwise occur in the development by the use of a cleanerless developing apparatus or cleanerless recording apparatus.

Another object of this invention is to provide a cleanerless developing method using a mono-component toner, which is capable of always producing an ideal image in spite of a possible change in the conditions for development.

The first aspect of this invention which is directed to a cleanerless developing method using a mono-component toner comprises a step for forming a latent image on the surface of a latent image retaining member by charging the surface in conjunction with residual toner adhering thereto by charging means and then subjecting the surface to the action of exposing means, a step for simultaneous developing and cleaning by causing a thin layer of toner formed on the surface of a toner carrying member of a developing device to be brought into contact with or opposed to the surface of the latent image retaining member already containing the latent image thereby converting the latent image into a toner image and, at the same time, causing the residual toner still persisting on the surface of the latent image retaining member after the transfer of the toner to be attracted into and recovered in the developing device, and a step for transferring the toner image onto the surface of an image carrying member by the use of transfer means, which method is characterized in that during the step for simultaneous developing and cleaning, the magnitude of charging, $q_t$, of the developing toner on the surface of the toner carrying member verging on entering the step mentioned above fulfills the expression, $0.5\ [mC/kg] \leqq |q_t| \leqq 40\ [mC/kg]$.

The second aspect of this invention which is directed to a cleanerless developing method using a mono-component toner is characterized in that the magnitude of charging, $q_r$, of the residual toner on the surface of the latent image retaining member verging on entering the step for simultaneous developing and cleaning fulfills the expression, $0.5\ [mC/kg] \leqq |q_r| \leqq 60\ [mC/kg]$.

The third aspect of this invention is directed to the first aspect of this invention plus a step for uniformizing the distribution of the residual toner by the use of residual toner uniformizing means subsequently to eliminate the charge of the residual toner persisting on the surface of the latent image retaining member after the transfer of image by the use of discharging means and is characterized in that the magnitude of charging, $q_z$, of the residual toner during the step for uniformization fulfills the expression, $|q_z| \leqq 40\ [mC/kg]$.

The occurrence of the positive memory or negative memory mainly depends on the magnitudes of charging of the developing toner and residual toner and the amount of the developing toner deposited on the surface of the toner carrying member (developing roller) and introduced into the step for development. If the magnitudes of charging of the developing toner and residual toner are unduly large, electrostatic repulsive force is generated between these two toners at the site of development and suffered to impair the developing and cleaning operation.

Conversely, if the magnitude of charging of the toner is conspicuously small, such problems as toner spillage and imperfect cleaning may occur.

If the amount of the developing toner is unduly large, the electric field for cleaning tends to be so weak as to induce the phenomenon of positive memory.

In accordance with this invention which has selected and set the magnitudes of charging of the developing toner and residual toner and the amount of the developing toner deposited on the surface of the toner carrying member (developing roller) and introduced into the step of development within the optimum ranges, therefore, the development can be attained with high density without entailing the problem of toner spill. Further, the image to be produced by this invention enjoys high quality and freedom from the phenomenon of memory because the residual toner is substantially removed by the electric field of cleaning. Moreover, the preclusion of the occurrence of memory can be ensured by selecting and setting the magnitude of charging of the residual toner during the step for uniformization within the optimum range and consequently uniformizing the distribution of the residual toner substantially.

The use of the method of this invention permits elongation of the service life of the developing apparatus because the potential of the latent image retaining member is allowed to remain at a low level.

DETAILED DESCRIPTION OF THE PREFERRED EMBODIMENTS

EXAMPLE 1

Now, this invention will be described more specifically below with reference to FIGS. 1 to 11 illustrating embodiments of this invention.

Figure 1:
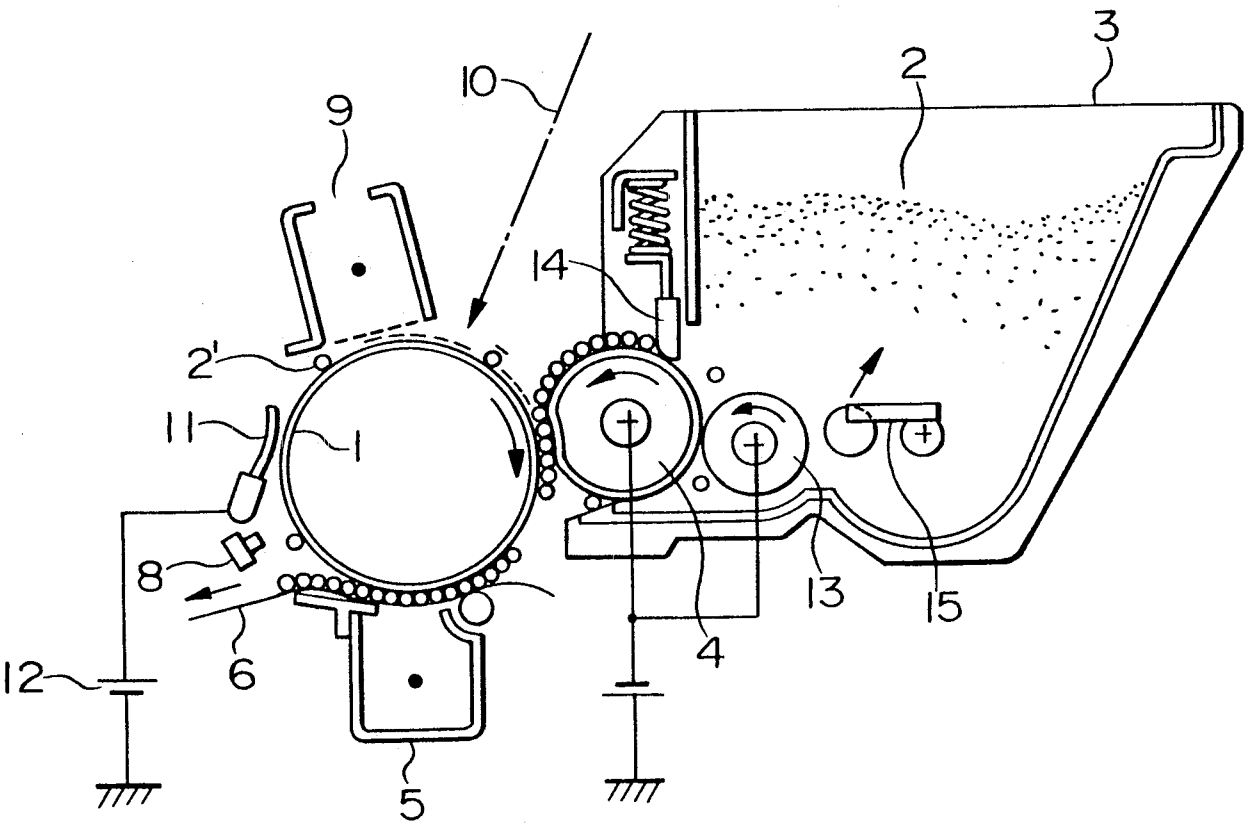
FIG. 1 is a cross section illustrating a representative construction of an essential part of a mono-component cleanerless recording apparatus to be used for a developing method which is contemplated by this invention.

In FIG. 1, 1 stands for an electrostatic latent image retaining member such as, for example, a negatively charging type organic photosensitive drum, 3 for a developing device such as, for example, a mono-component nonmagnetic developing device, and 4 for a toner carrying member (developing roller) attached to the developing device 3. The toner carrying member 4 is rotated at a peripheral speed of about 1.2 to 4.0 times the peripheral speed of the latent image retaining member 1 as held in light contact with the surface of the latent image retaining member 1 through the medium of a thin layer of the toner carried on the surface thereof. The toner carrying member (developing roller) 4 comprises an electroconductive polyurethane rubber roller and a coating of electroconductive urethane elastomer formed on the surface of the roller. In FIG. 1, 5 stands for a transfer charging device, 8 for a discharge lamp, 9 for a charging device (Scoroton charging device), 10 for a light beam (laser beam), 11 for a uniformizing brush, 12 for a DC power source for imparting required potential to the uniformizing brush 11, 13 for a toner feeding roller for supplying a toner 2 to the toner carrying member 4, 14 for a toner layer thickness regulating member having a terminal face thereof opposed to the surface of the toner carrying member 4 by the action of a spring, 15 for a toner stirring element, and 2' for toner remaining after the transfer.

Now, the simultaneous developing and cleaning characteristic in the cleanerless process of the developing method contemplated by this invention and the mechanism for the occurrence of memory will be described below based on theoretical analysis and experimental data.

Figure 2:
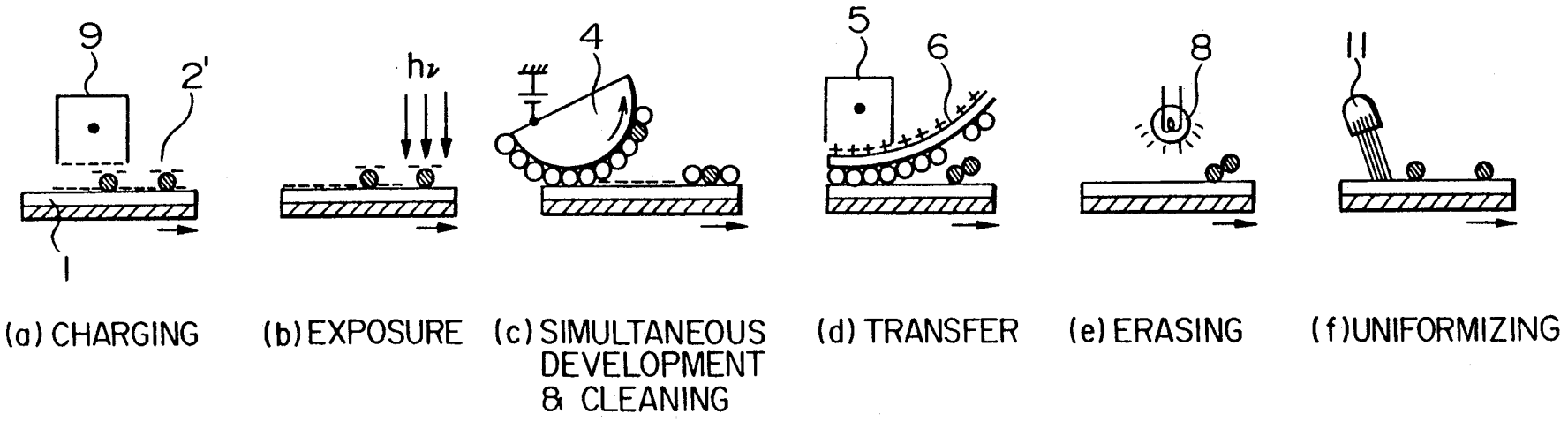
FIG. 2 illustrates by the use of types a process of image development in the method of developing according to this invention;, Sub-FIG. 2 (*a*) is a diagram illustrating the state of impartation of static potential to the surface of a latent image retaining member having residual toner adhere thereto, Sub-FIG. 2 (*b*) a diagram of the step for forming a latent image, illustrating the state of exposing to the light the surface of the latent image retaining member having static potential imparted thereto, Sub-FIG. 2 (*c*) a diagram of the step for simultaneous developing and cleaning, illustrating the state of effecting simultaneous developing and cleaning by causing the developing toner carried on the surface of the toner carrying member to contact the exposed surface of the latent image retaining member, Sub-FIG. 2 (*d*) a diagram of the step for image transfer, illustrating the state of transferring the toner image on the surface of the latent image retaining member onto the surface of the image carrying member, Sub-FIG. 2 (*e*) a diagram illustrating the state of effecting discharge of the surface of the latent image retaining member after the transfer, and Sub-FIG. 2 (*f*) a diagram of the step for uniformizing the distribution of the residual toner adhering to the surface of the latent image retaining member by the use of a uniformizing member.

First, the step of development with a cleanerless printer which utilizes the principle of contact type mono-component nonmagnetic development (formation of image) will be shown in the form of types in FIGS. 2 (*a*) to (*f*). During this step of development, the surface of the latent image retaining member 1 having the residual toner 2' deposited thereon is vested with required charge by the charging device 9 [FIG. 2 (*a*)] and the surface of the latent image retaining member 1 is exposed to a laser beam to have a required latent image formed and carried thereon [FIG. 2 (*b*)]. Subsequently, the surface of the latent image retaining member 1 on which the latent image has been formed and deposited is brought into light contact with the surface of the toner carrying member 4 carrying the toner thereon to effect development of the latent image and, at the same time, cleaning of the surface of the latent image retaining member 1 [FIG. 2 (*c*)]. The toner image consequently deposited on the surface of the latent image retaining member 1 is transferred onto the image carrying member (transfer paper) 6 by the use of the transfer charging device 5 [FIG. 2 (*d*)]. Thereafter, the surface of the latent image retaining member 1 is deprived of electric charge by the discharging lamp 8 [FIG. 2 (*e*)] and the uniformizing brush 11 uniformizes the distribution of the residual toner 2, on the surface of the latent image retaining member 1 [FIG. 2 (*f*)].

In an optical printer using the reversal developing method, the developing and cleaning operations can be simultaneously executed by the step of development described above. To be more specific, the toner is deposited on the exposed part of the latent image retaining member 1 and, at the same time, the residual toner 2' persisting on the unexposed part is attracted onto the surface of the toner carrying member 4 and recovered in the developing device 3. The contact type monocomponent nonmagnetic development (formation of image) using an elastic electroconductive roller is capable of forming a strong electric field for cleaning and exhibiting a high capacity for cleaning and, therefore, may well be regarded as suitable for the process under discussion.

If the amount of the residual toner 2' is extremely large, the image to be formed incurs positive or negative memory. In actuality, however, the occurrence of the memory mentioned above can be substantially precluded by having the distribution of the residual toner 2' uniformized in the step for uniformizing the residual toner 2' illustrated in FIG. 2 (*f*).

Figure 3:
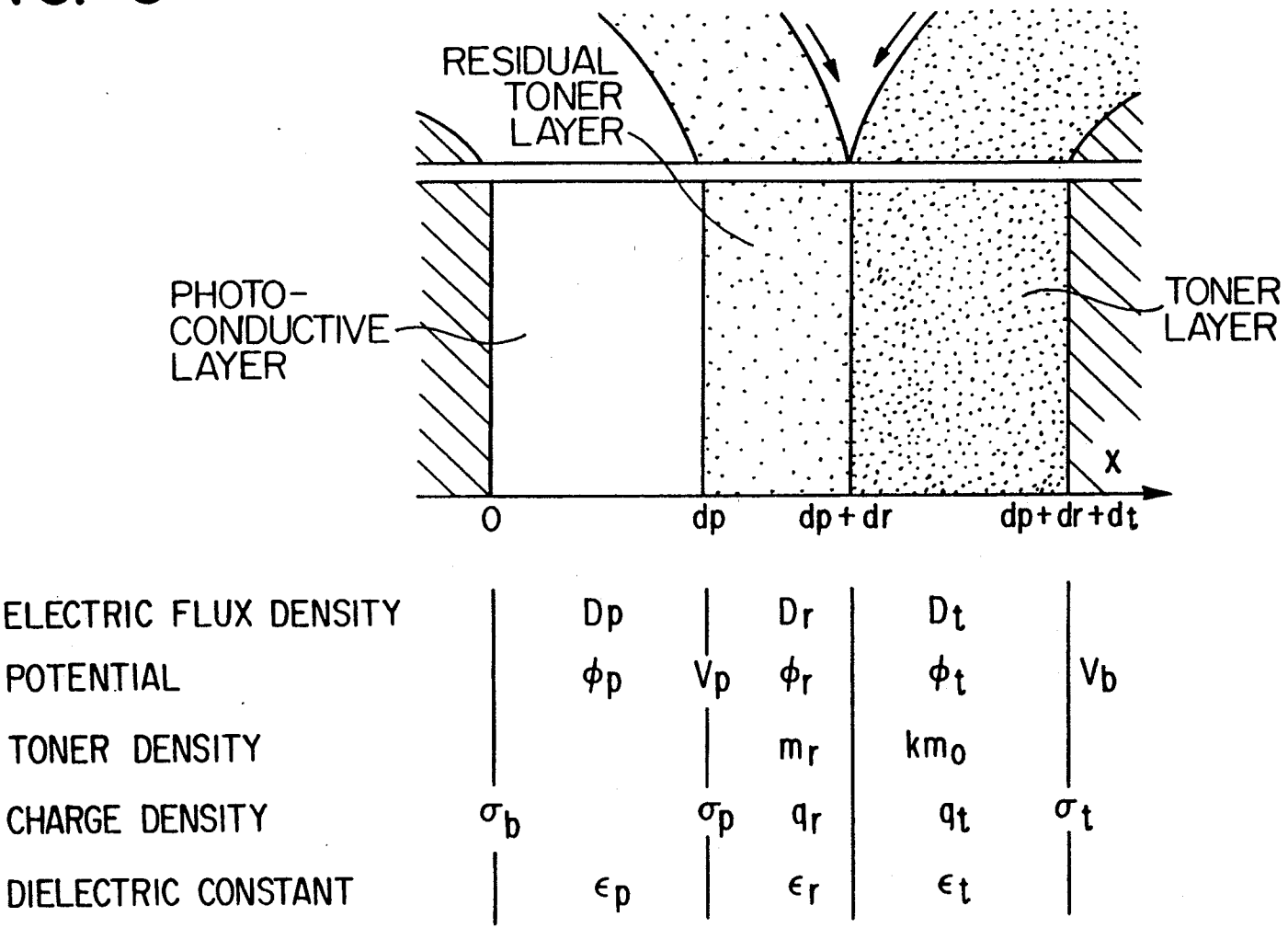
FIG. 3 is a diagram illustrating by means of a model an area of simultaneous developing and cleaning in the developing method contemplated by this invention.

Now, the mechanism for the simultaneous developing and cleaning will be described with reference to FIG. 3. On the assumption that the developing toner layer and the residual toner layer are each a homogeneous dielectric layer, the Poisson's equation concerning the potential $\phi$ will be solved by applying the Gaussian law to the photosensitive layer, the residual toner layer, and the developing toner layer respectively.

$\mathrm{div}\ D_p=0$ $\mathrm{div}\ D_r=q_r m_r/d_r$ $\mathrm{div}\ D_t=q_t k m_0/d_t$ Here, the boundary conditions based on the unit vector n in the direction of x will be expressed as follows.

$D_p \cdot n=\sigma_p$ $(D_r-D_p)\cdot n=\sigma_p$ $(D_t-D_r)\cdot n=0$ $-D_t n=\sigma_t$ $\phi_p(0)=0$ $\phi_p(d_p)=\phi_r(d_p)$ $\phi_r(d_p+d_r)=\phi_t(d_p+d_r)$ $\phi_t(d_p+d_r+d_t)=V_b$ $\sigma_p=\epsilon_p(V_p/d_p)$ The potentials, $\phi_r$ and $\phi_t$, in the toner layers are found by solving the problems of boundary values mentioned above. At the point, $X_o$, at which the electric field $-d\phi/dx$ becomes zero, the toner layers are separated and the developing or cleaning is completed. The cleaning is carried out when the expression, $X_o<d_p+d_r$, is satisfied and the developing is carried out when the expression, $X_o>d_p+d_r$, is satisfied. The amounts of toners deposited on the surface of the latent image retaining member are derived respectively from $m_r(X_o-d_p)/d_r$ and $Km_o(X_{o-dp}-d_r)/d_t+m_r$, wherein k stands for the ratio of the speed, $V_d$, of the surface of the toner carrying member to the speed, $V_i$, of the surface of the latent image retaining member ($V_d/V_i$), $m_o$ for the weight of the developing toner deposited on the surface of the toner carrying member per unit area of the surface, and $m_r$ for the weight of the residual toner deposited on the surface of the latent image retaining member per unit area of the surface.

The analysis shown above produces the following equations on the developing and cleaning operations.

Equation on developing operation ($m \geqq m_r$):

$$m=\frac{1}{A}\left\{-\frac{V_p-V_b}{q_t}-\frac{q_r}{q_t}\left(\frac{d_r}{2\epsilon_r}+\frac{d_p}{\epsilon_p}\right)m_r+\frac{km_o}{2}\ \frac{d_t}{\epsilon_t}\right)+m_r$$

Equation on cleaning operation ($m \leqq m_r$):

$$m=\frac{1}{A}\left\{-\frac{V_p-V_b}{q_r}-\left(\frac{d_r}{2\epsilon_r}+\frac{d_t}{\epsilon_t}\right)m_r+\frac{km_o}{2}\ \frac{d_r q_t}{\epsilon_t q_r}\right\}$$

wherein A stands for the sum, $(d_p/\epsilon_p)+(d_r/\epsilon_r)+(d_t/\epsilon_t)$.

A review on the question how the magnitude of $V_p$ in the equations shown above is affected by the presence of the residual toner reveals that the residual toner particles intercept the corona ions during the step of charging and consequently decrease the value, $|V_p|$. On the assumption that the toner particles have a spherical shape, the equation $\eta=\pi R^2 \cdot mr[\frac{4}{3}\pi\rho R^3]=3mr/4\rho R$ is satisfied, wherein $\pi$ stands for the covering ratio of the surface of the latent image retaining member 1 and $\rho$ stands for the true specific gravity of toner. Let $V_i$ stand for the surface potential of the entire latent image retaining member on which the toner has been deposited, $V_t$ for the contribution of the part on which the toner has been deposited, and $V_o$ for the contribution of the part on which no toner has been deposited, the potentials exhibit linear dependency on the amount, $m_r$, of the residual toner and the action of the residual toner manifested during the step of charging is expressed as follows.

$$V_o=Km_r-500 \qquad (1)$$

wherein $V_o$ stands for the initial potential during the step of exposure.

When the exposure to the laser beam is effected through the medium of the residual toner with respect to the initial potential, $V_o$, during the step of exposure, the transmittance of light through the residual toner layer is $1-\eta$. Let $I_o$ stand for the incident energy of the laser beam, and the energy which impinges on the surface of the latent image retaining member will be given by the following expression.

$$I=I_o(1\eta)=I_o[1-(3m_r/4\rho R)]$$

The interception of the light en route to the surface of the latent image retaining member 1 by the amount of the residual toner, $m_r$, is given by the following expression.

$$\text{where } m_r \leqq m_o\ I=I_o(1-k_2 m_r)\ldots \qquad (2)$$

$$\text{where } m_r \leqq m_o\ I=I_o(k_3/m_r)\ldots \qquad (3)$$

Figure 4:
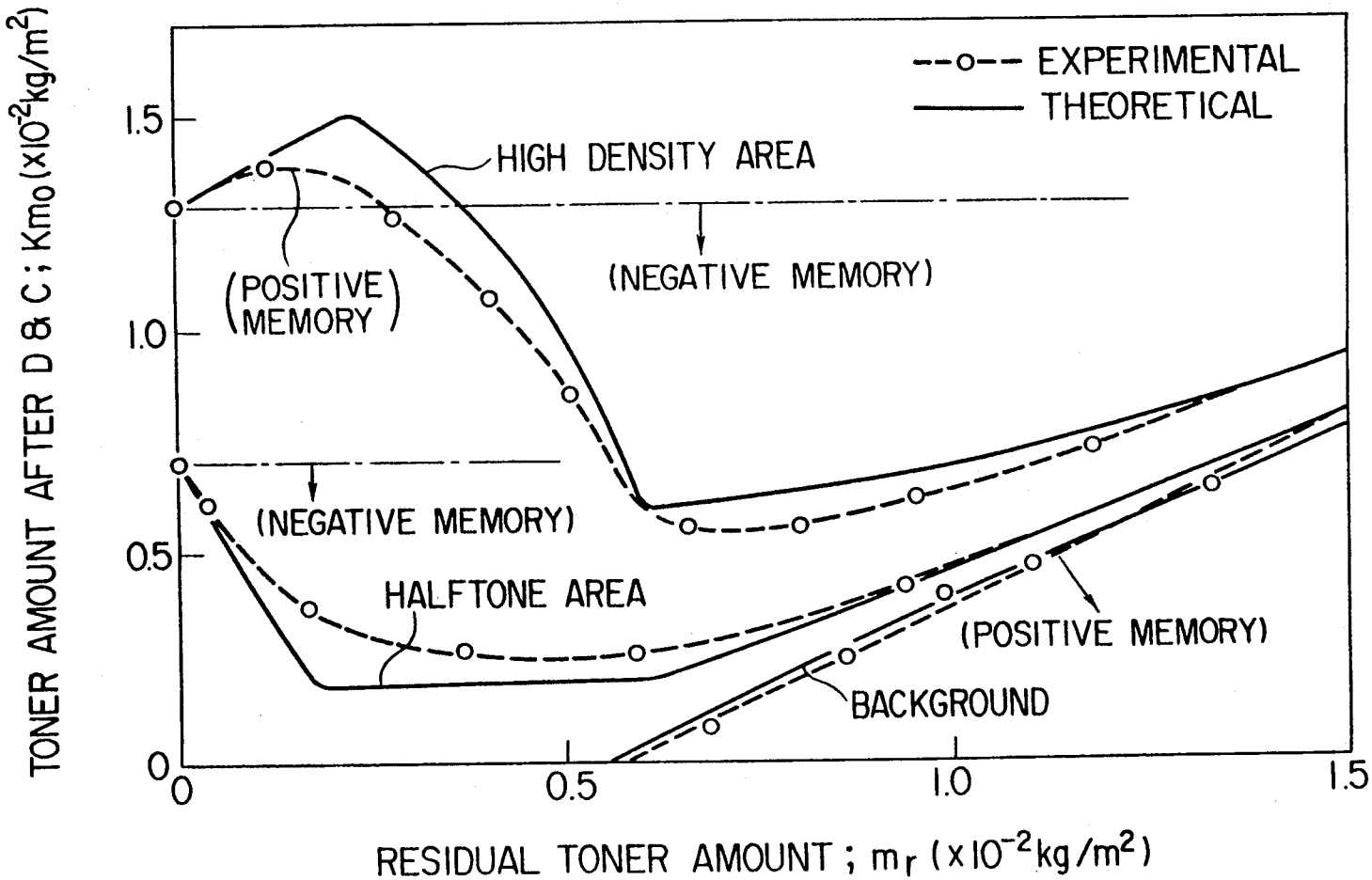
FIG. 4 is a curvilinear diagram illustrating the theoretical and experimental data obtained on the relation between the amount of residual toner and the amount of toner deposited after the simultaneous developing and cleaning in the developing method contemplated by this invention.

The initial potential $V_o$ on the surface of the latent image retaining member is varied by the aforementioned exposed to $V_p$. In consideration of the occurrence of light carrier and the phenomenon of transportation in the laminated type organic photosensitive member, for example, the light attenuation characteristic of the surface potential $V_p$ of the latent image retaining member can be approximated to the following three expressions.

Where $I<I_l$:

$$V_p=((k_4 I-500-V_r)(V_o-V_r)/(-500-V_r))+V_r \quad (4)$$

Where $I_1 \leqq I \leqq I_2$:

$$V_p=((k_5 \exp(-k_6 1)-V_r)(V_o-V_r)/(-500-V_r))+V_r \quad (5)$$

Where $I_2<I \leqq I_o$:

$$V_p=((k_7/(I-k_8)+k_9-V_r)(V_o-V_r)/(500-V_r))+V_{hd\,r} \quad (6)$$

wherein $V_p \leqq -50$ V, $I_o$ stands for the maximum value of the energy of exposure on the surface of the latent image retaining member, I stands for the energy of exposure after passage through the residual toner layer, and $k_1$ to $k_9$ and $I_o$ and $I_2$ stand for constants. By substituting the expressions (1) to (6) in the aforementioned equations on developing and cleaning operations, the amount, m, of the toner which adheres to the latent image retaining member after the simultaneous developing and cleaning operation can be expressed as the function of the amount, $m_r$, of the residual toner. FIG. 4 illustrates the relation between the amount, m, of the toner deposited on the latent image retaining member and the amount, $m_r$, of the residual toner. It is clearly noted from the diagram of FIG. 4 that the results of experiment (dotted line) faithfully follow the theoretical curve (solid line) based on the model.

In the computations shown above, the following numerical values were used.

$m_0=0.64\times10^{-2}$(kg/m$^2$), $m_c=0.607\times10^{-2}$(kg/m$^2$),
$V_p=-200$ v, $V_r==-50$ V,
$d_p=20$ μm, $d_l=11$ μm, $d_r=m_r\times10^{-3}$ (m),
$\epsilon_p=3.4\ \epsilon_0$, $\epsilon_r=1.0\ \epsilon_0=1.1\ \epsilon_0$,
$q_l=-5.6\times10^{-3}$(C/kg), $q_r=-24\times10^{-3}$ (C/kg),
$k=2.0$, $k_l=1.20\times10^4$, $k_2=1.24\times10^2$, $k_3=0.15\times10^{-2}$,
$k_4=1.74\times10^5$, $k_5=-515$, $k_6=450$, $k_7=-0.23$, $k_8=1.1\times10^{-3}$, $k_9=-9$,
$I_l=0.9\times10^{-3}$(J/m$^2$), $I_2=3.66\times10^{-3}$(J/m$^2$), $I_0=13.2\times10^{-3}$(J/m$^2$).

Now, the developing and cleaning characteristics will be described below based on the models confirmed as described above.

Figure 5:
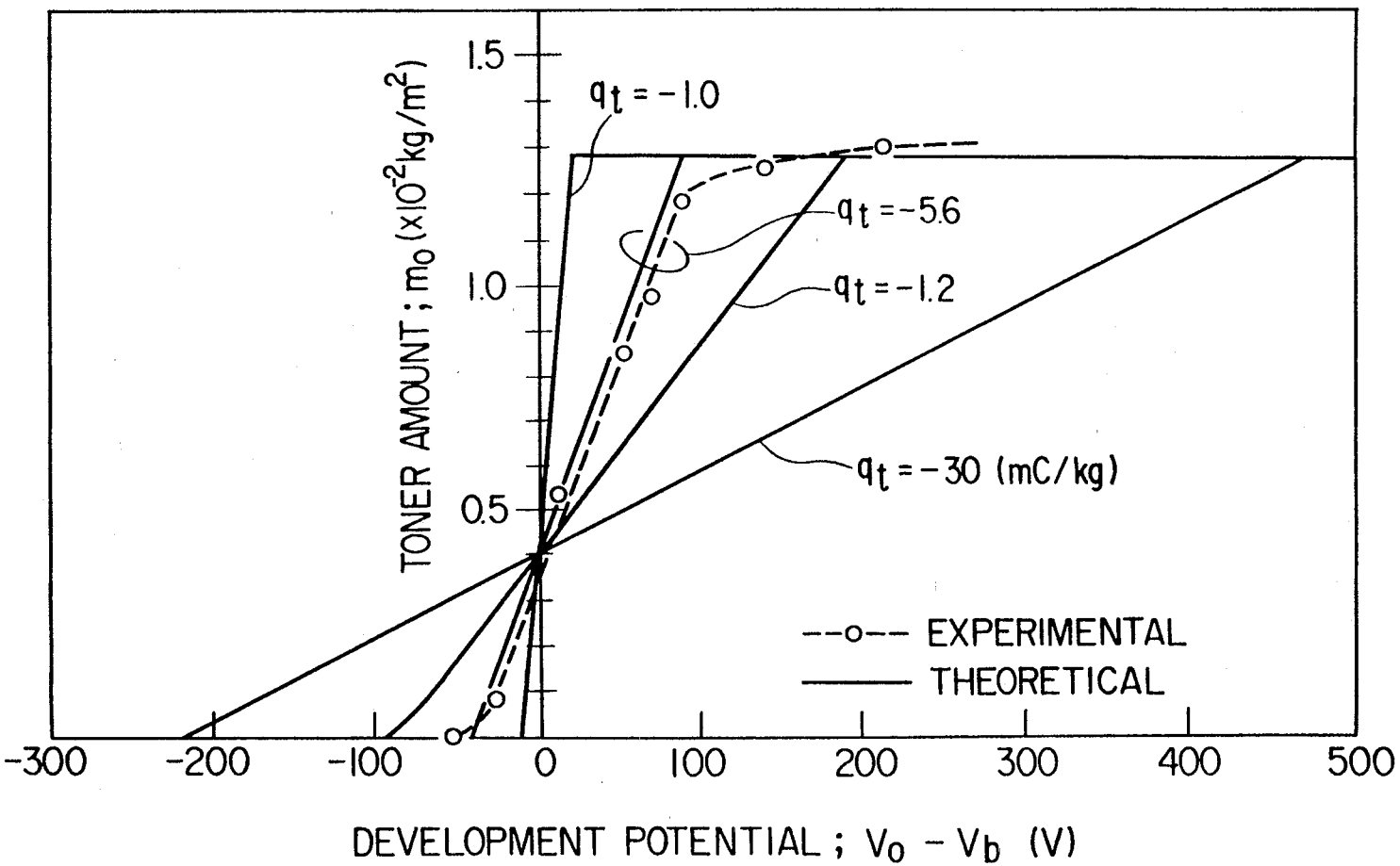
FIG. 5 is a curvilinear diagram illustrating the theoretical and experimental data obtained on the relation between the magnitude of developing potential and the amount of toner deposited in the developing method contemplated by this invention.

First, a review of the effect of the magnitude of charging of the developing toner verging on entering the step of developing reveals that in the absence of the residual toner, the developing characteristic exhibits such dependency as shown in FIG. 5 on the magnitude, $q_t$, of charging of the developing toner deposited on the surface of the toner carrying member. When the value of $|q_t|$ is low, the characteristic assumes a two-value quality as surmised from a sharp inclination of the straight line representing it. The characteristic changes and assumes an analogous quality as the value of $|q_t|$ increases. By repressing the magnitude of charging of the developing toner to a low level, the development at low potential can be realized.

Figure 6:
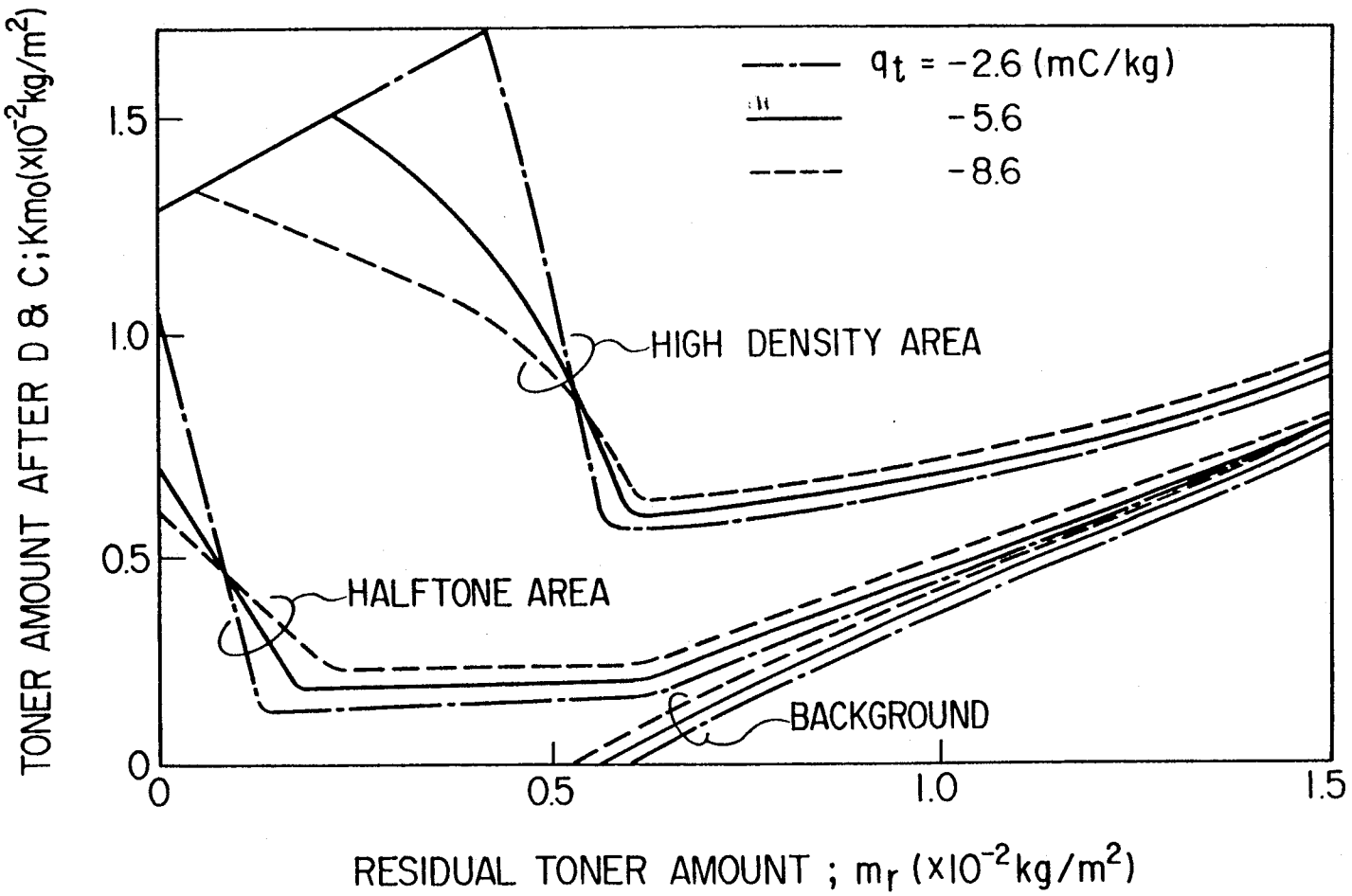
FIG. 6 is a curvilinear diagram illustrating the theoretical and experimental data obtained on the relation between the amount of the toner deposited after the simultaneous developing and cleaning and that of the residual toner deposited on the surface of the latent image retaining member in the developing method contemplated by this invention.
Figure 7:
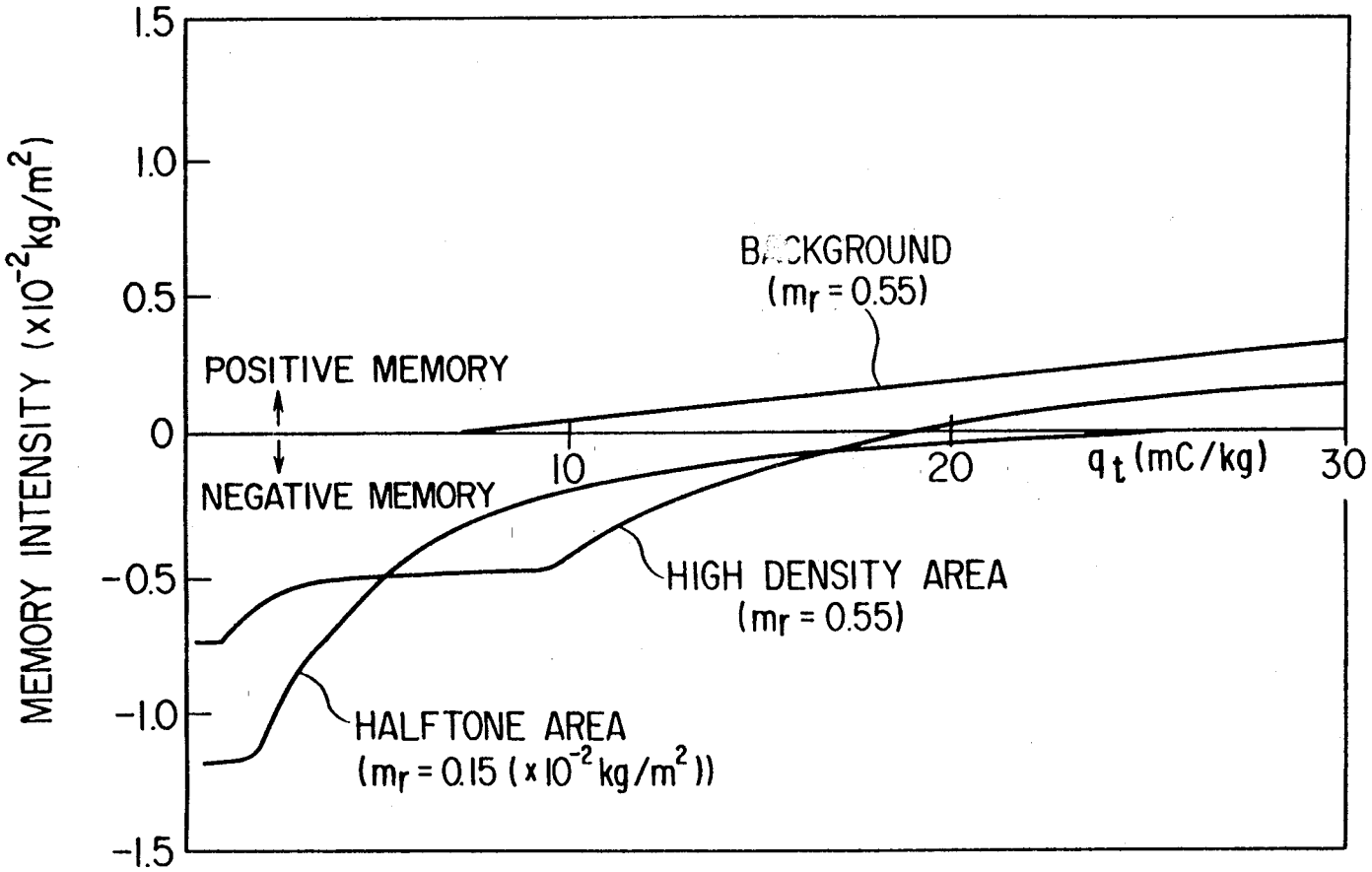
FIG. 7 is a curvilinear diagram illustrating the theoretical and experimental data obtained of the relation between the magnitude of charging of the toner and the intensity of memory in the developing method contemplated by this invention.

FIG. 6 shows the effect of the magnitude of charging of the developing toner on the developing and cleaning characteristics. In the high-density part and the halftone part, the conspicuity with which the negative memory manifests increases in proportion as the magnitude, $|q_t|$, of charging of the developing toner decreases. This is because the developing characteristic gains in steepness and the variation of the potential of the latent image retaining member 1 is emphasized by the action of light interception as the value of $|q_t|$ decreases. There is observed meanwhile an inclination that the ease with which the positive memory occurs in the background increases in proportion as the magnitude, $|q_t|$, of charging of the developing toner increases. FIG. 7 shows the inclination of the magnitude of charging of the developing toner and the occurrence of memory (intensity of memory). The intensity of memory has been defined by the difference in the amount of the toner deposited on the latent image retaining member 1 in the part allowing persistence of the residual toner 2' and in the part allowing no persistence thereof.

Figure 8:
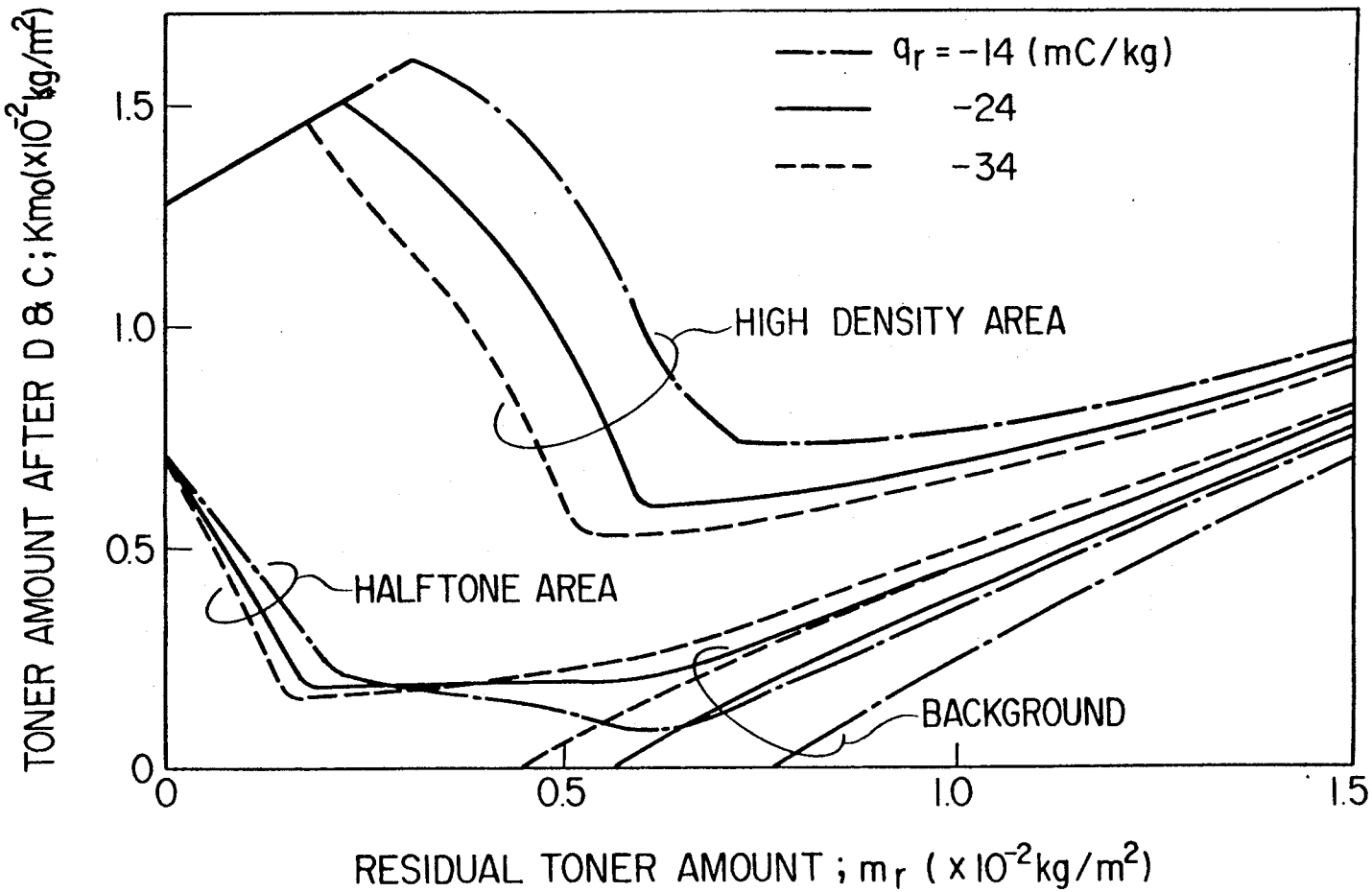
FIG. 8 is a curvilinear diagram illustrating the theoretical and experimental data obtained on the relation between the amount of the toner deposited after the simultaneous developing and cleaning and that of the residual toner deposited on the surface of the latent image retaining member in the developing method contemplated by this invention.
Figure 9:
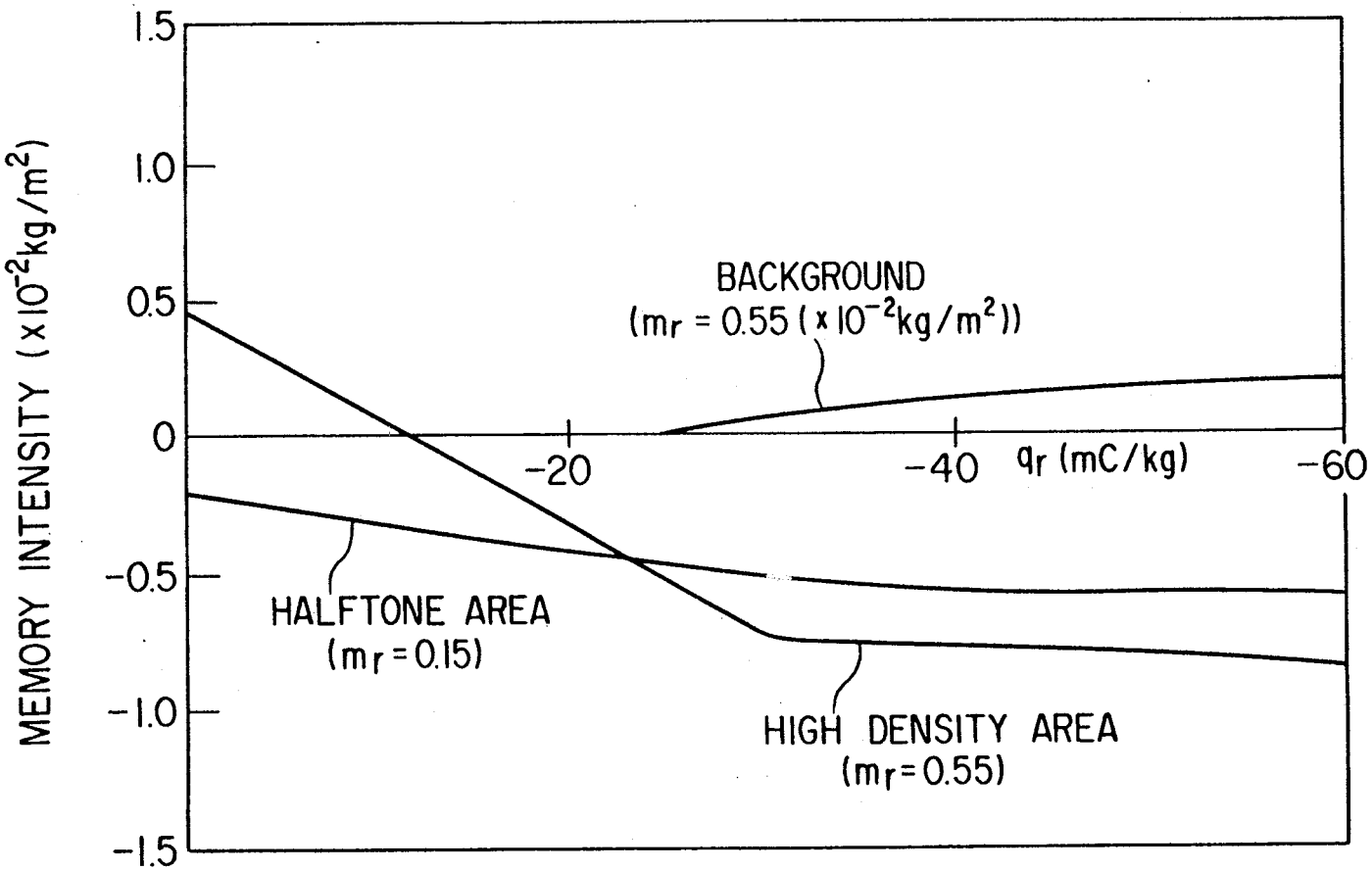
FIG. 9 is a curvilinear diagram illustrating the relation between the magnitude of charging of the toner and the intensity of memory in the developing method contemplated by this invention.
Figure 10:
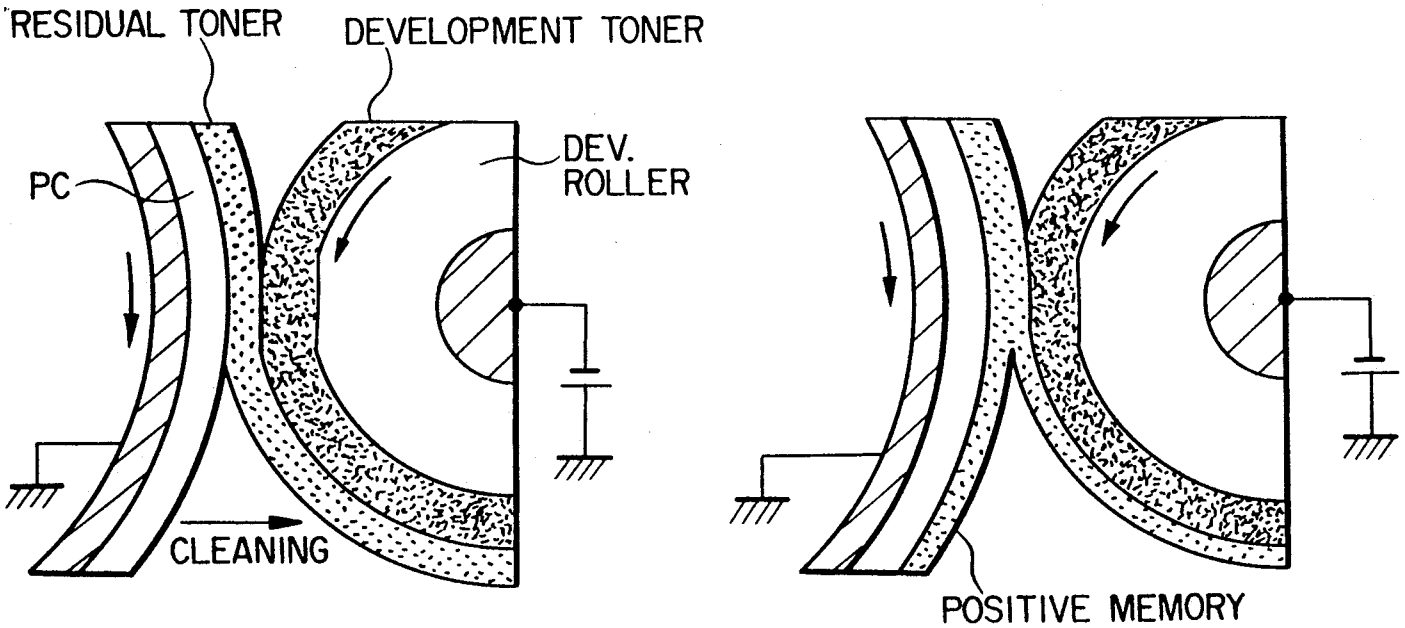
FIG. 10 is a type diagram illustrating by the use of a model the phenomenon of simultaneous developing and cleaning in the developing method contemplated by this invention; Sub-FIG. 10(*a*) is a cross section illustrating the state of ideal performance of the cleaning and Sub-FIG. 10(*b*) a cross section illustrating the state of suffering persistence of positive memory.

A review of the effect of the magnitude of charging of the residual toner verging on entering the step of developing reveals an inclination that unlike the developing toner described above, the repression of the occurrence of memory grows in conspicuous invariability in the high-density part, the halftone part, and the background in proportion as the magnitude, $|q_r|$, of charging of the residual toner decreases as shown in FIG. 8 and FIG. 9, for example. When the magnitude, $|q_r|$, of charging of the residual toner is large, the cleaning is attained only with difficulty and the background tends to generate a positive memory because the residual toner is strongly restrained toward the latent image retaining member side. The ease with which the negative memory is generated increases in proportion as the magnitude, $|q_r|$, of charging of the residual toner increases because the residual toner exerts electrostatic repulsive force on the developing toner unexceptionally in the image part. FIG. 10 (*a*) and (*b*) illustrate in types the behaviors of the simultaneous developing and cleaning operations mentioned above. It is clearly noted from the diagrams that the required cleaning operation proceeds easily when the magnitude, $q_r$, of charging of the residual toner 2' is −24 (mC/kg), whereas the background tends to generate a positive memory when the magnitude, $q_r$, of charging of the residual toner 2' is −34 (mC/kg).

These results and inclinations imply that the amount of negative corona ions (the ions which are generated when corona discharge is performed in the air) imparted to the residual toner during the step of charging the latent image retaining member is desired to be as small as possible. The contact type mono-component nonmagnetic developing method is capable of producing required development even when the potential of the latent image retaining member falls short of 500 V and, therefore, is suitable for the cleanerless process.

In case where the toner has a conspicuously high capacity for charging, for example, the charging of the toner remaining after the transfer can be controlled by lowering the voltage of the charging device thereby decreasing the amount of corona ions to be generated.

In this case, since the surface potential of the latent image retaining member is sympathetically lowered, the necessity arises for adapting other processes such as the bias of development and the amount of exposure to light for the surface potential $V_0$. The use of the mono-component contact developing method has realized low-potential development. As another way of accomplishing the adaptation, a method which effects required shifting of the magnitude of charging the toner by excessively increasing the magnitude of the voltage which is applied to the uniformizing brush in polarity opposite the polarity of the toner may be employed.

Figure 11:
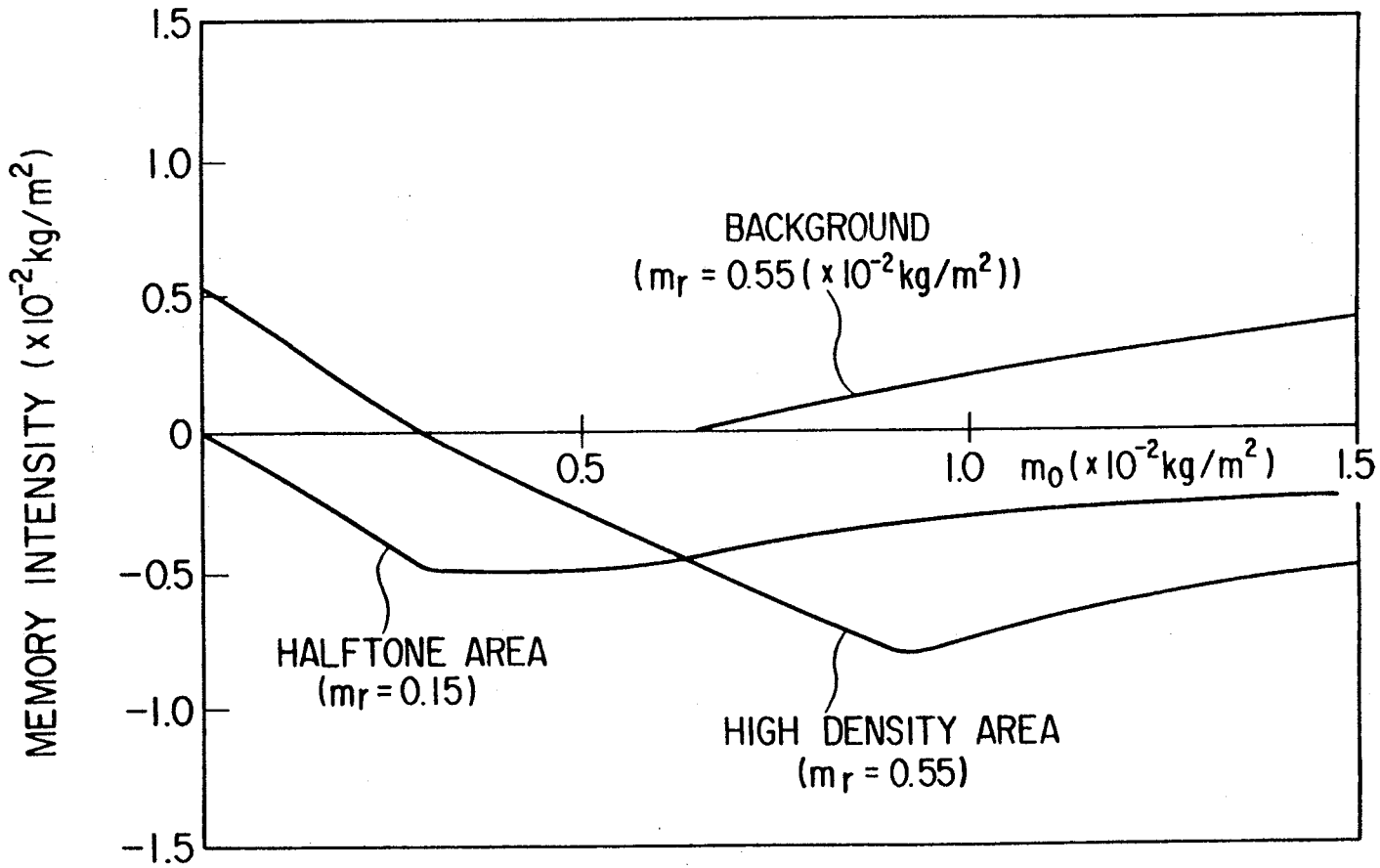
FIG. 11 is a curvilinear diagram illustrating the relation between the amount of the developing toner verging on entering the step of development and the intensity of memory in the developing method contemplated by this invention.
Figure 12:
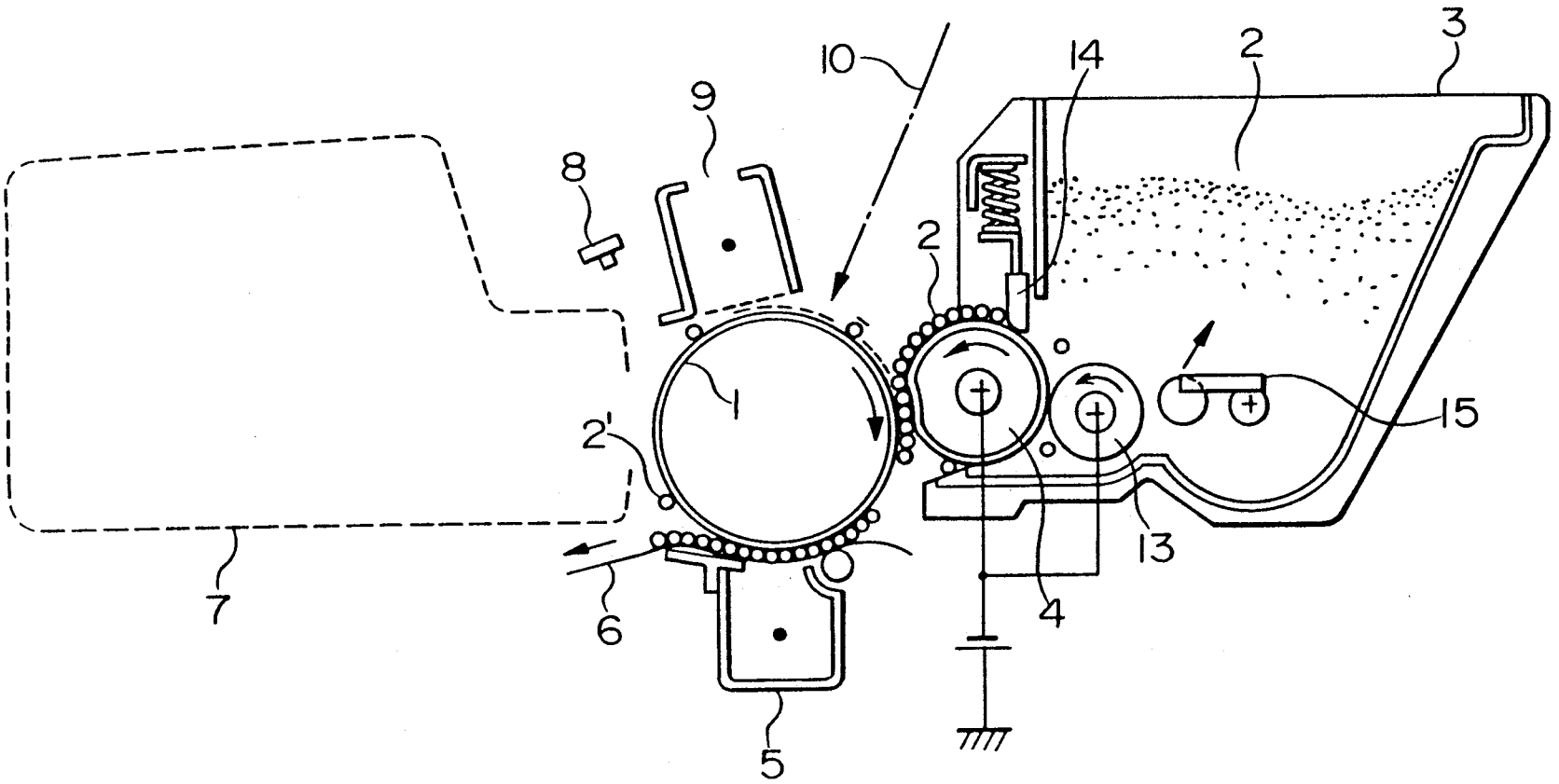
FIG. 12 PRIOR ART
FIG. 12 is a cross section illustrating a representative construction of an essential part of a cleanerless recording apparatus to be used in the conventional cleanerless developing operation.

The amount, $m_0$, of the developing toner to be deposited on the surface of the toner carrying member 4 and supplied to the step of development also affects the aforementioned developing and cleaning characteristics. FIG. 11 shows the relation between the amount, $m_0$, of the developing toner and the intensity of memory. Generally, there is recognized an inclination that the occurrence of memory is repressed in proportion as the amount, $m_0$, of the developing toner is decreased. Thus, selection of developing conditions which allow required image density to be obtained with the amount, $m_0$, of the developing toner decreased to the lowest possible level constitutes itself an important requirement. Further, the change in the speed ratio, k, of the toner carrying member and the latent image retaining member has an effect on the adjustment of the amount, $m_0$, of the developing toner verging on entering the step of development and, therefore, brings about the same operation and effect as in the amount, $m_0$, of the developing toner relative to the intensity of memory. When the speed ratio, k (difference in speed), is proper, it aids in repressing the aggregation and adhesion of the residual toner and accelerating the cleaning action.

For the purpose of enabling the cleanerless developing method to produce ideal records and images, optimum ranges must be specifically selected and set for such magnitudes as the magnitude of charging of the toner as described above. Now, this point will be described below.

First, for the cleanerless developing method of this invention, the absolute value of the magnitude, $|q_t|$, of charging the developing toner must be in the range between 0.5 [mC/kg] and 40 [mC/kg].

The reason for the lower limit, 0.5 [mC/kg], of the absolute value of the magnitude, $|q_t|$, of charging the developing toner is that the force of adhesion of the developing toner to the surface of the toner carrying member is sufficiently high and the possible separation of the developing toner from the surface of the toner carrying member in the process of conveyance is substantially precluded. The reason for the upper limit, 40 [mC/kg], of the absolute value of the magnitude, $|q_t|$, of charging the developing toner is that the inclination of the developing characteristic is not suffered to decrease notably as shown in FIG. 5 and the necessity for setting the absolute value of the surface potential of the latent image retaining member 1 above 1,000 V is obviated. If the absolute value of the surface potential of the latent image retaining member 1 is set at a level exceeding 1,000 V, the latent image retaining member 1 requires high potential and, as a result, the amount of negative corona ions imparted to the residual toner increases possibly to the extent of rendering required cleaning difficult to attain and depriving the latent image retaining member 1 of practicability. Hence, the absolute value of the magnitude, $|q_t|$, of charging the developing toner is selected below 40 [mC/kg]. Incidentally, the magnitude of charging the developing toner is determined as follows. It is the numerical value which is obtained by blowing the toner adhering to the surface of the latent image retaining member with a strong current of air and, at the same time, measuring the enantiomorphous charge fleeing from the electroconductive base of the latent image retaining member, and dividing the consequently found numerical value of the charge by the weight of the toner.

From the practical point of view, the efficiency of transfer of the toner during the step of transfer is approximately in the range between 60 and 90%. Even if the residual toner is exposed to the work of uniformization by the use of the uniformizing brush 11, it occasionally happens that the amount of the residual toner falls in the neighborhood of 0.1 [$\times 10^{-2}$ kg/m$^2$]. It is known empirically that the residual toner existent in the amount of 0.1 [$\times 10^{-2}$ kg/m$^2$] defies all efforts of cleaning when the magnitude, $|q_t|$, of charging the developing toner exceeds 40 [mC/kg]. It is, therefore, desirable to set the upper limit of the magnitude, $|q_t|$, at 40 [mC/kg].

The magnitude, R, of inherent electric resistance of the toner is selected to satisfy $R \geqq 1 \times 10^{13}$ Ω·cm. The reason for this limit is that the magnitude of charge which the toner remaining on the surface of the latent image retaining member after the transfer assumes on passing through the step of charging falls short of 0.5 [mC/kg] in absolute value and the cleaning tends to become incomplete if the magnitude, R, is less than $1 \times 10^{13}$ Ω·cm.

To summarize the example described above, it is desirable that the magnitude, R of inherent electric resistance of the developing toner should satisfy the expression $R \geqq 1 \times 10^{13}$ Ω·cm., the absolute value of the magnitude, $|q_t|$, of charging the developing toner should fall in the range between 0.5 [mC/kg] and 40 [mC/kg], preferably between 0.5 [mC/kg] and 20 [mC/kg], and the magnitude, R, of inherent electric resistance of the toner should satisfy the expression $R \geqq 1 \times 10^{13}$ Ω·cm.

The polarity of the charge of the developing toner is selected to equal that of the latent image retaining member 1 because the development is performed by the reversal process.

EXAMPLE 2

This example specifically demonstrates the relation between the magnitude of charging the residual toner and the simultaneous developing and cleaning characteristics. Six species of developing toner differing in the magnitude, R, of inherent electric resistance have been used in this experiment. Incomplete cleaning is liable to occur when the magnitude, R, of inherent electric resistance of the toner is less than $1 \times 10^{13}$ Ω·cm. A study in search of the cause of this phenomenon reveals that the magnitude of charging the residual toner immediately before the step of development possibly falls short of 0.5 [mC/kg] and, as a result, the cleaning effected by the electric field tends to become incomplete. In other words, when the magnitude of resistance of the toner is low, the charge imparted to the residual toner during the step of charging flees before the residual toner reaches the step for development and, as a result, the Coulomb force is not sufficient for required cleaning.

It has been demonstrated that incomplete cleaning or generation of memory tends to occur under all practicable conditions if the magnitude of charge which the residual toner assumes after the step of impartation of a latent image exceeds 60 [mC/kg]. In short, since the magnitude of charging is unduly large, the enantiomorphous force generated by the latent image retaining member in the direction of the electroconductive base extremely increases and, consequently, renders cleaning difficult and tends to induce insufficient development (namely negative memory) through growth of the electrostatic repulsive force of the developing toner.

To summarize this example, it is desirable that the magnitude, R, of inherent electric resistance of the toner should satisfy the expression $R \geqq 1 \times 10^{13}$ Ω·cm and the absolute value of the magnitude, $|q_r|$, of charge which the residual toner assumes on passing through the step of formation of latent image should fall in the range between 0.5 [mC/kg] and 60 [mC/kg], preferably between 8 [mC/kg] and 40 [mC/kg]. The polarity of the charge of the residual toner is selected to equal that of the latent image retaining member 1 because the development is performed by the reversal process.

EXAMPLE 3

This example specifically demonstrates an experiment for obtaining sufficient image density while substantially effecting the cleaning operation. For the purpose of substantially performing the cleaning operation, it is desirable as described already that the amount, $km_0$, of the developing toner verging on entering the step of development should be decreased to the fullest possible extent. Meanwhile for the purpose of obtaining sufficient image density, it is important from the practical point of view that the amount, $km_0$, of the developing toner verging on entering the step of development should exceed at least 0.6 [$\times 10^{-2}$ kg/m$^2$]. As already described, k stands for the speed ratio of the surface of the latent image retaining member 1 and the surface of the toner carrying member 4 and $m_0$ for the amount, [kg/m$^2$], of the developing toner conveyed as deposited on the surface of the toner carrying member 4. If the amount of the developing toner introduced into the step of development is less than 0.6 [$\times 10^{-2}$ kg/m$^2$], the optical density of the image transferred onto and fixed on the surface of the transferred image carrying member (such as, for example, paper) falls below 1.0 even when the whole toner contributes to the development. Thus, the image to be produced suffers from poor quality.

Conversely, if the amount, $km_0$, of the developing toner introduced into the step of development exceeds 3.0 [$\times 10^{-2}$ kg/m$^2$], complete elimination of the generation of positive memory or the incompleteness of cleaning is attained only with difficulty under practical conditions. This is because the thickness of the toner layer intervening between the toner carrying member 4 and the latent image retaining member 1 unduly increases and the electric field for cleaning is weakened to the extent of preventing the ability of cleaning from being fully manifested.

Further, the capacity for simultaneous developing and cleaning is amply manifested when the amount of the developing toner to be supplied and the magnitude of charging the developing toner both fall in the optimum ranges. When the amount of the developing toner to be supplied is 1.1 [$\times 10^{-2}$ kg/m$^2$] and yet the magnitude of charging the developing toner is 43.1 [mC/kg], the inclination of the developing characteristic becomes notably small and, as a result, the development with the developing toner becomes difficult to attain. For the purpose of attaining ample developing potential, therefore, the potential of charging the photosensitive element must be increased in the proximity of 1,000 V. Since the magnitude of charging the developing toner is high, the force of electrically repelling the residual toner is conspicuous and, as a result, the residual toner escapes being recovered into the developing device and instead lends itself to the generation of positive memory. When the amount of the developing toner to be supplied is proper and yet the magnitude of charging the developing toner is not proper, it is difficult to attain simultaneous developing and cleaning ideally. When the amount of the developing toner to be supplied is 1.1 [$\times 10^{-2}$ kg/m$^2$] and the magnitude of charging the developing toner is 12.7 [mC/kg], the capacity for simultaneous developing and cleaning is manifested safely. The image to be consequently obtained enjoys high quality and freedom from generation of memory. For the purpose of enabling the method of simultaneous developing and cleaning to produce ideal development, it is necessary that the amount of the developing toner to be supplied to the site of development should be controlled within the optimum range. As surmised from the example cited above, the control exclusively of the amount of the developing toner to be supplied will not suffice but entail inconveniences due to the increase of the potential of charging the latent image retaining member and suffer the occurrence of toner spill. It has been demonstrated that for the solution of the various problems mentioned above, ample manifestation of the performance of the cleanerless developing method is ensured by combining the control of the amount of the toner with the adjustment of the magnitude of charging the developing toner in the optimum range.

To summarize this example, it is important that the amount, $km_0$, of the developing toner to be supplied to the opposed latent image during the step of development should be set in the range between 0.6 [$\times 10^{-2}$ kg/m$^2$] and 3.0 [$\times 10^{-2}$ kg/m$^2$], preferably between 0.6 [$\times 10^{-2}$ kg/m$^2$] and 1.8 [$\times 10^{-2}$ kg/m$^2$]. It is desirable in this case that the magnitude, R, of inherent electric resistance of the toner should satisfy the expression, $R \geqq 1 \times 10^{13}$ Ω·cm and further the absolute value of the magnitude, $|q_t|$, of charging the developing toner should fall in the range between 0.5 [mC/kg] and 40 [mC/kg]. It is more preferably that the magnitude of charging the residual toner after the step of impartation of a latent image should be selected to satisfy 0.5 [mC/kg] $\leqq |q_r| \leqq$ 60 [mC/kg].

EXAMPLE 4

This example specifically demonstrates the effects of the magnitude, $q_t$, of charging the developing toner and the magnitude, $q_r$, of charging the residual toner exerted on the simultaneous developing and cleaning operations. The results of the experiment indicate that the product, $q_t q_r$, of the magnitude, $q_t$, of charging the developing toner multiplied by the magnitude, $q_r$, of charging the residual toner should fall in the range between 0.25 and 1,800. It has been demonstrated that ideal simultaneous developing and cleaning characteristics are manifested when the absolute values, $|q_t|$ and $|q_r|$, are small and these absolute values are required only to exceed the respective lower limits, 0.5 and 0.5. Here, the equality of the magnitudes, $q_t$ and $q_r$, in point of polarity of charging, forms an essential requirement for the simultaneous developing and cleaning operations. Further, the magnitude, $q_t$, of charging the developing toner and the magnitude, $q_r$, of charging the residual toner are preferably negative polarity. The product, $q_t q_r$, therefore, assumes the minimum value of 0.25. With respect to the maximum values, the values of the expressions, $|q_t| \leqq 40$ and $|q_r| \leqq 60$, indicated in the other examples do not apply as they do to the present experiment. The reason for this discrepancy is that under the conditions, $|q_t| = 40$ and $|q_r| = 60$, since the two magnitudes of charging are very large, the two species of toner generate a conspicuous electrostatic repulsion during the step of development to induce positive memory due to incomplete cleaning and negative memory due to incomplete development. It has been demonstrated that the problem of the occurrence of memory mentioned above is eliminated when the upper limit of the product, $q_t q_r$, is set at 1,800.

To summarize this example, it is particularly desirable that the magnitude, R, of inherent electric resistance of the developing toner should satisfy the expression, $R \geqq 1 \times 10^{13}$ Ω·cm. and the product, $q_t q_r$, of the magnitude, $q_t$ [mC/kg], of charging the developing toner entering the step of development multiplied by the magnitude, $q_r$ [mC/kg], of charging the residual toner should be selected and set within the range between 0.25 and 1,800.

EXAMPLE 5

This example specifically demonstrates the effect of the state of distribution of the residual toner remaining on the surface of the latent image retaining member on the occurrence of memory. First, the residual toner is uniformized by the uniformizing member. The uniformizing materials which are effectively usable in this invention include a brush and plates and rollers made of foamed elastomer, rubber, flexible film, and metal. The uniformization as an operation may be attained by a mechanical action due to contact of this uniformizing member. Desirably, the residual toner is uniformized by an electrical action by application of voltage to the uniformizing member which is made of an electroconductive substance.

In any event, the magnitude of charging the residual toner constitutes itself as an important factor for effective fulfillment of the uniformization of the distribution of the residual toner. If the magnitude of charging of the residual toner is extremely large, the enantiomorphous force generated by the latent image retaining member in the direction of the electroconductive base increases to the extent of rendering difficult the uniformization of the toner by the uniformizing member. In case where the uniformizing member is made of an electroconductive substance and adapted to operate by application of voltage, the latent image retaining member can be prevented from dielectric breakdown and the uniformization aimed at can be ensured by limiting the absolute value of the voltage to be applied to a level below 800 V in the use of direct current and to a level below 3 KV of peak difference in the use of alternating current. The results of the experiment indicate that under the conditions mentioned above, the absolute value of the magnitude, $|q_z|$, of charging the residual toner during the step of uniformization should have the upper limit thereof set at 40 [mC/kg]. Where the uniformization is to be carried out by the use of a nonconductive member 11, the lower limit is desired to be set at 20 [mC/kg].

The magnitude, $q_z$, of charging the residual toner during the step of uniformization is a numerical value which is determined as follows. When all the actions proceeding during the execution of the step of development are stopped, the residual toner is found adhering to the surface of the latent image retaining member in the part extending from the area for transfer to the area for uniformization. The latent image retaining member in this state is removed from the apparatus, the residual toner persisting in the part extending from the area for transfer to the area for uniformization is blown off with a strong current of air and, at the same time, the enantiomorphous charge, $q_z'$, fleeing from the electroconductive base of the latent image retaining member is measured. Here, $q_z'$ is equal in magnitude to $q_z$ and different in sign of polarity therefrom. The weight of the toner can be found by weighing the latent image retaining member before and after the expulsion of the toner from the surface thereof and computing the difference between the two weights.

For the purpose of accomplishing the uniformization of the residual toner more effectively, it is desirable that the potential of the latent image retaining member should be also uniformized before this latent image retaining member reaches the step for uniformization. To be more specific, it is desirable that a discharging lamp, a corona charger for discharging, or an electroconductive brush for discharging should be installed at a position intervening between the site for the step of transfer and the site for the step of uniformization and the absolute value of the surface potential of the latent image retaining member should be set at a level below about 200 V. By setting the absolute value of the surface potential of the latent image retaining member at a level below about 200 V, the adhesive force of the residual toner to the surface of the latent image retaining member can be weakened and the uniformization of the residual toner can be substantially accomplished. Of course, no use is found for the work of uniformizing the potential where the uniformization by the use of the uniformizing member produces conspicuous operation and effect.

As described above, the developing method contemplated by this invention, namely the so-called cleanerless developing method, exhibits outstanding simultaneous developing and cleaning characteristics and always allows production of images of ideal quality without entailing the generation of memory. This ability of the method to produce images of high quality easily and substantially coupled with relatively simple and expeditious operation of the cleanerless developing apparatus brings about numerous advantages from the practical point of view. Further, the adoption of the developing method contemplated by this invention adds to the service life of the developing apparatus because it allows the potential of the latent image retaining member to be kept at a low level.

What is claimed is:

1. A cleanerless developing method using a mono-component toner, comprising:

a step of forming a latent image on the surface of a latent image retaining member;

a simultaneous developing and cleaning step of causing a thin layer of the mono-component toner formed on the surface of a toner carrying member of a developing device to be brought into contact with or opposed to the surface of said latent image retaining member having said latent image formed thereon thereby converting said latent image into a toner image and, at the same time, causing residual toner remaining on the surface of said latent image retaining member after the transfer of said toner to be attracted into and recovered in said developing device;

an image transfer step of effecting transfer of said toner image onto the surface of an image carrying member; and a uniformizing step of uniformizing the distribution of said residual toner remaining on the surface of said latent image retaining member after said transfer of image;

wherein the relation, $|q_z| \leqq 40$ mC/kg, is satisfied $q_z$ standing for the magnitude of charging of the residual toner during said uniformizing step.

2. A method according to claim 1, wherein the relation, $|q_z| \leqq 20$ mC/kg,is satisfied.

3. A method according to claim 1, wherein the absolute magnitude of the surface potential of the latent image retaining member, prior to the uniformizing step, is 200 V or less.

4. A method according to claim 1, wherein the absolute magnitude of direct current applied to a uniformizing member of the uniformizing step is 800 V or less.

5. A method according to claim 1, wherein peak difference of alternating current applied to a uniformizing member of the uniformizing step is 3 KV or less.

6. A method according to claim 1, wherein the relation, 0.5 mC/kg$\leqq |q_t| \leqq$40 mC/kg, is satisfied, $q_t$ standing for the magnitude of charging of the developing toner deposited on the surface of said toner carrying member, which verges on entering the simultaneous developing and cleaning step.

7. A method according to claim 6, wherein the relation, 0.5 mC/kg$\leqq |q_t| \leqq$20 mC/kg, is satisfied.

8. A method according to claim 6, wherein the relation, 0.5 mC/kg$\leqq |q_r| \leqq$60 mC/kg, is satisfied, $q_r$ standing for the magnitude of charging of the residual toner deposited on the surface of said latent image retaining member, which verges on entering the simultaneous developing and cleaning step.

9. A method according to claim 8, wherein the relation, 0.15 $(mc/kg)^2 \leqq q_t \cdot q_r \leqq 1800$ $(mC/kg)^2$, is satisfied.

10. A method according to claim 8, wherein both $q_t$ and $q_r$ are negative polarity.

11. A method according to claim 10, wherein the relations, 0.25 $(mC/kg)^2 \leqq q_t \cdot q_r \leqq 1800$ $(mC/kg)^2$, and $R \geqq 1 \times 10^{13}$ Ωcm, are satisfied, R standing for the magnitude of inherent electric resistance of the mono-component toner.

12. A method according to claim 8, wherein the amount of the developing toner to be supplied is in the range between $0.6 \times 10^{-2}$ kg/m$^2$ and $3.0 \times 10^{-2}$ kg/m$^2$.

13. A method according to claim 6, wherein the amount of the developing toner to be supplied is in the range between $0.6 \times 10^{-2}$ kg/m$^2$ and $3.0 \times 10^{-2}$ kg/m$^2$.

14. A method according to claim 6, wherein the amount of the developing toner to be supplied is in the range between $0.6 \times 10^{-2}$ kg/m$^2$ and $1.8 \times 10^{-2}$ kg/m$^2$.

15. A method according to claim 6, wherein the relation, $R \geqq 1 \times 10^{13}$ Ω·cm, is satisfied, R standing for the magnitude of inherent electric resistance of the mono-component toner.

16. A method according to claim 6, wherein the polarity of charging of the developing toner and the polarity of the surface of the latent image retaining member are the same.

17. A method according to claim 1, wherein the relation, 0.5 mC/kg$\leqq |q_r| \leqq$60 mC/kg, is satisfied, $q_r$ standing for the magnitude of charging of the residual toner deposited on the surface of said latent image retaining member, which verges on entering the simultaneous developing and cleaning step.

18. A method according to claim 17, wherein the relation, 8 mC/kg$\leqq |q_r| \leqq$40 mC/kg, is satisfied.

19. A method according to claim 17, wherein the relation, $R \geqq 1 \times 10^{13}$ Ω·cm, is satisfied, R standing for the magnitude of inherent electric resistance of the mono-component toner.

20. A method according to claim 17, wherein the polarity of charging of the residual toner and the polarity of the surface of the latent image retaining member are the same.

21. A cleanerless developing method using a mono-component toner, comprising:

a step of forming a latent image on the surface of a latent image retaining member;

a simultaneous developing and cleaning step of causing a thin layer of the mono-component toner formed on the surface of a toner carrying member of a developing device to be brought into contact with or opposed to the surface of said latent image retaining member having said latent image formed thereon thereby converting said latent image into a toner image and, at the same time, causing residual toner remaining on the surface of said latent image retaining member after the transfer of said toner to be attracted into and recovered in said developing device; and an image transfer step of effecting transfer of said toner image onto the surface of an image carrying member;

wherein the relations 0.5 mC/kg$\leqq |q_r| \leqq$60 mC/kg, and $R \leqq 1 \times 10^{13}$ Ω·cm, are satisfied, $q_r$ standing for the magnitude of charging of the residual toner deposited on the surface of said latent image retaining member, which verges on entering the simultaneous developing and cleaning step, and R standing for the magnitude of inherent electric resistance of the mono-component toner.

22. A method according to claim 21, wherein the relation, 8 mC/kg$\leqq |q_r| \leqq$40 mC/kg, is satisfied.

23. A method according to claim 21, wherein the relation, 0.5 mC/kg$\leqq |q_t| \leqq$40 mC/kg, is satisfied, $q_t$ standing for the magnitude of charging of the developing toner deposited on the surface of said toner carrying member, which verges on entering the simultaneous developing and cleaning step.

24. A method according to claim 23, wherein both $q_t$ and $q_r$ are negative polarity, and the relation, 0.25 $(mC/kg)^2 \leqq q_t \cdot q_r \leqq 1800$ $(mC/kg)^2$, is satisfied.

* * * * *

UNITED STATES PATENT AND TRADEMARK OFFICE

CERTIFICATE OF CORRECTION

PATENT NO. : 5,283,618

DATED : February 01, 1994

INVENTOR(S) : Masahiro HOSOYA et al.

It is certified that error appears in the above-indentified patent and that said Letters Patent is hereby corrected as shown below:

Title page, column 1, lines 2-3, after Inventors change "Isutomu Uehara" to --Tsutomu Uehara--.

Claim 9, column 17, line 42, change "0.15 $(mc/kg)^2$" to --0.25 $(mC/kg)^2$--.

Claim 21, column 18, line 43, change "$\leqq$" to --$\geq$--.

Signed and Sealed this

Twenty-fifth Day of October, 1994

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,283,618

DATED : February 01, 1994

INVENTOR(S) : Masahiro HOSOYA et al.

It is certified that error appears in the above-indentified patent and that said Letters Patent is hereby corrected as shown below:

Title page, column 1, after Assignee: Kabushiki Kaisha Toshiba, Kanagawa, insert --;Tokyo Electric Co., Ltd., Tokyo, both of--.

Signed and Sealed this

Twelfth Day of November, 1996

*Attest:*

Bruce Lehman

BRUCE LEHMAN

*Attesting Officer*

*Commissioner of Patents and Trademarks*